United States Patent [19]

Cardus

[11] 4,016,617

[45] Apr. 12, 1977

[54] ELECTRICALLY OPERABLE APPARATUS FOR THE APPLICATION OF A TREATING PRODUCT

[76] Inventor: Francis Cardus, 39-41, rue de la Glaciere, Paris, France

[22] Filed: Dec. 31, 1975

[21] Appl. No.: 645,909

[30] Foreign Application Priority Data

Jan. 6, 1975 France ..... 75.00265

[52] U.S. Cl. ..... 15/4; 15/29

[51] Int. Cl.[2] ..... A47L 23/06; A46B 13/02

[58] Field of Search ..... 15/4, 28, 29, 97 A

[56] References Cited

UNITED STATES PATENTS

| | | | |
|---|---|---|---|
| 2,728,928 | 1/1956 | Beeren | 15/4 X |
| 2,882,538 | 4/1959 | Beeren | 15/4 X |

FOREIGN PATENTS OR APPLICATIONS

| | | | |
|---|---|---|---|
| 1,503,906 | 7/1969 | Germany | 15/29 |

*Primary Examiner*—Edward L. Roberts
*Attorney, Agent, or Firm*—Michael J. Striker

[57] ABSTRACT

An electrically driven hand-held apparatus, for applying a treating material, such as wax, to a surface and for subsequently buffing up the surface or working the treating material thereinto, has a central applicator element surrounded by an annular buffing or brushing element, these elements being relatively displaceable axially so as to present one or the other in a projecting working position. The elements are rotatable by a bidirectional motor, and are coupled by an arrangement which ensures that reversing the direction of rotation automatically causes the relative axial displacement of the two elements. The applicator element may have a reservoir for the treating product, and a spring-loaded feed piston therein. The reservoir may have a valved inlet, and a stem may be inserted for filling the reservoir from an aerosol can. The applicator element and the buffing or brushing element may be removable and replaceable as an assembly.

7 Claims, 6 Drawing Figures

ELECTRICALLY OPERABLE APPARATUS FOR THE APPLICATION OF A TREATING PRODUCT

The maintenance or treatment of many materials, by application of a particular product, necessitates two quite separate operations, namely: the application proper of this product and the subsequent buffing up of the corresponding surface. However, the apparatuses currently used in cases of this kind are designed solely to assure this latter operation. It is thus necessary to proceed, beforehand, with the application of the corresponding product, for example a maintenance product, such as wax. Now this requires various operations which are to a greater or lesser extent laborious and dirtying.

The present invention accordingly has for an object to avoid these inconveniences by providing an apparatus capable of carrying out both the application of the maintenance product or treating product and the subsequent buffing up of the surface treated, or again the working of the product thereinto.

For this purpose the apparatus according to the invention comprises a working head including both a central element for application of the product to be applied and, about the latter, a rotary annular brushing or rubbing element, one of these two elements being mounted so as to be axially movable in order to permit bringing one and the other thereof into operation, this apparatus being characterised in that these two elements are coupled by a coupling system adapted to assure the axial displacement of the movable element, in one direction and the other, under the effect of reversing the direction of rotation of the other element which is coupled to the rotary driving shaft, the corresponding motor being capable of functioning in one direction and the other.

In an advantageous form of construction, the element which is mounted to be movable in the axial direction is the annular brightening or rubbing element, the central element then being coupled directly with the driving shaft. Thus, by causing the motor to turn in one direction and the other it is possible to transform the working head of the present apparatus in order to adapt it to the two operations to be carried out, that is to say:

the application of the product to be applied by means of the central element driven in rotation by the motor, the annular brushing or rubbing element being brought into the position of withdrawal as soon as this operation commences, by reason of the threading provided between these two elements:

then the buffing up or the working-in of the product to be applied, by reversing of the direction of rotation of the motor, in such a manner as to control the displacement in projection of the annular brushing or rubbing element, the central applicator element then being placed in a withdrawn position.

Preferably, the central applicator element comprises a reservoir intended to contain the corresponding product as well as an applicator pad of flexible material, for example of porous material, or of fabric, the reservoir being provided with a movable feeding piston subjected to the action of a spring. Furthermore, this applicator element can advantageously be provided with a filling opening permitting the periodical filling of its reservoir. However, it is also possible to construct this central applicator element in the form of a dismountable assembly which can be replaced by another similar assembly after use of the contents of its reservoir.

However, other features and advantages of the present apparatus will appear in the course of the following description. This is given with reference to the accompanying drawing, which is by way of illustration only, and in which.

Figure 1:
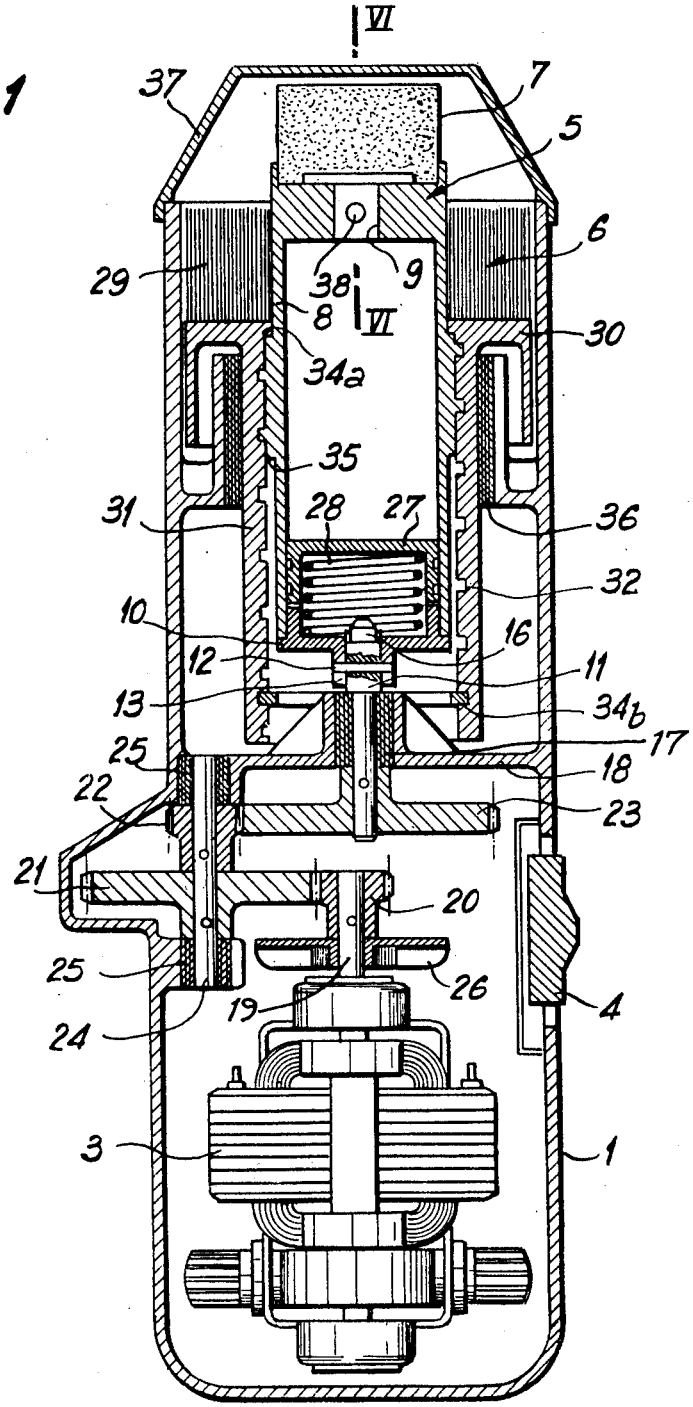
FIG. 1 is a view in axial section of this apparatus.

The present apparatus comprises a casing formed by two shells 1 and 2 moulded of synthetic plastics material. At its rear part this casing encloses a small bidirectional electric motor 3. This motor is controlled by a switch the operating member of which consists of a knob 4 mounted slidably in an opening of the wall of the casing and accessible at the exterior, this knob having three positions of use, i.e.: a central position of non-operation and two extreme positions corresponding respectively to the use of the present apparatus as an applicator of a maintenance product and its employment for brightening, which is to say buffing or brushing.

The knob 4 of the switch is conveniently placed on the casing in order to permit use of the present apparatus with one hand. For this purpose, the casing can be provided with a manipulating handle or it can quite simply comprise external mouldings fitting it to the shape of a hand.

The forward part of the casing has a cylindrical shape and it encloses the two working elements of the present apparatus, that is to say: a central applicator element designated by general reference 5 and, about this latter, an annular element for brushing or rubbing, designated by the general reference 6.

These two elements are rotatably mounted and are driven in rotation by the motor 3. One of these elements is moreover movable in the longitudinal direction. In the example shown, it is in fact the annular element 6 which is intended to be movable between a rest position, withdrawn with respect to the applicator element, and a working position projecting with respect to the latter.

The central applicator element 5 comprises an application pad 7 of flexible porous material, disposed at the end of a cylindrical reservoir 8 comprising an axial outlet channel 9. The mouth of this channel may be provided with a valve (not shown) intended for permitting the outflow of the product to be applied only during the effective use of the applicator element, this valve functioning under the effect of the application of the pad 7 on the surface to be coated. The body of this reservoir is fixed on a member 10 constituting the base of the latter. This member is secured for rotation to a driving shaft 11 by means of a pin 12 carried by this shaft and of which the projecting ends are engaged in recesses 13 formed in a collar 14 provided on the base 10.

This method of mounting permits easy mounting of the base of the reservoir on the extremity of the shaft 11 and of its subsequent removal therefrom. However, the base of the reservoir 8 is fixed stationarily in the axial direction by engagement on the extremity of the shaft 11, by means of two transverse resilient wires 15 adapted to engage into a throat 16 formed on the extremity of this shaft.

This latter is mounted rotatably on a self-lubricating bearing 17 carried by a transverse wall 18 of the casing. Moreover this shaft is coupled, by means of a speed reducer, with the output shaft 19 of the driving motor 3. This speed reducer is constituted by a series of pinions and of toothed wheels designated by references 20, 21, 22 and 23, the shaft 24 common to the toothed wheel 21 and to the pinion 22 being mounted rotatably in self-lubricating bearings 25.

In regard to the output shaft 19 of the motor, this carries a fan 26 intended to assure the cooling of the motor. The reservoir 8 encloses in its base a piston 27 adapted to push out the product to be applied. For this purpose a compression spring 28 is interposed between this piston and the base 10 of the reservoir.

In the example shown, the annular buffing element 6 consists of a brush 29 fixed on the end wall 30 of a sleeve 31 mounted about the body of the reservoir 8. However this sleeve is coupled to the latter by a quick-thread constituted by a projecting thread of only a few turns provided on the external wall of the reservoir and a helicoidal groove 32 extending along all of the length of the internal wall of the sleeve 31. The arrangement is such that this sleeve can displace axially, by screwing up or unscrewing with respect to the threading of the body of the reservoir, between a rest withdrawn position, shown in FIG. 1, and a projecting working position illustrated in FIG. 3. These two positions are determined by stops provided for this purpose on this sleeve.

The first of them consists of an internal shoulder **34*a* of the forward extremity of the sleeve intended to abut against a corresponding external shoulder of the body 8 of the reservoir, as shown in FIG. 1. As to the second stop provided on the sleeve 31, it consists of a segment 34*b* positioned in the rear extremity of this latter and which is intended to abut against an external shoulder 35 of the body 8 of the reservoir when the annular element 6 is in its projecting working position. It is to be noted that the sleeve 31 is guided in its movements of rotation and of translation by a self-lubricating ring 36**.

Figure 2:
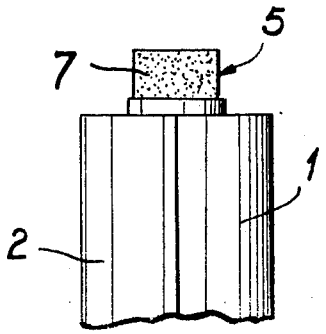
FIGS. 2 and 3 are partial elevational views of the forward end of this apparatus, respectively in its position of applying and of buffing or brushing.

In order to proceed to the application of the product to be applied, it suffices to turn the motor 3 in the required direction to cause threading of the sleeve 31 on the body 8 of the reservoir of the central element in such a manner that the annular buffing element 6 thus comes into the withdrawn position. This result is obtained as a result of the effect of frictional resistances which are exerted on the sleeve 31, whilst the central working element 5 is coupled directly to the driving shaft 11. The annular buffing element thus places itself automatically in its rest position shown in FIG. 1, in such a manner that only the applicator pad 7 of the applicator element projects at the exterior, as illustrated in FIG. 2. Thus it suffices to apply this pad on the surface to be treated and to displace it thereon to cause coating with the corresponding product. This operation is very easy to perform and it takes place under excellent conditions because the pad 7 is driven in rotation. Furthermore, precisely because of the manner of conception of the apparatus, the operator does not risk in any way undesirable dirtying of his hands in the course of this operation.

Figure 3:
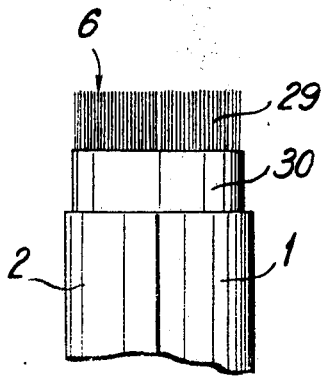

In order to proceed thereafter to buffing up, it is sufficient to reverse the direction of rotation of the driving motor. In effect this causes an axial displacement of the sleeve 31 and of the brush 29 towards the front. This latter thus comes into a projecting position with respect to the pad 7, as shown in FIG. 3. Under these conditions this pad 7 is placed out of service and the brush 29 assures the required buffing up.

Of course, during the change of position, the movable annular element 6 keeps in its new position, by reason of the stops **34*a* and 34*b* which have been mentioned above. When the apparatus is not in use, a protective cap 37** can be fitted on the front end of its casing.

Figure 6:
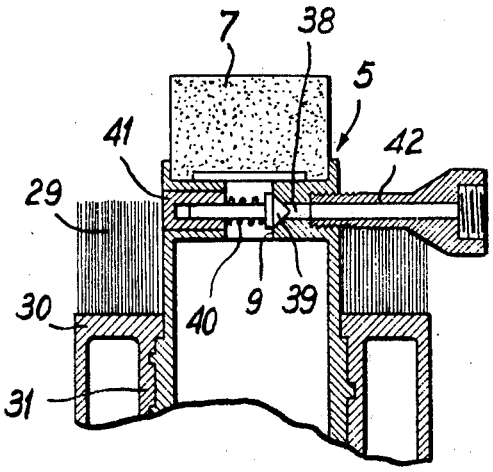
FIG. 6 is a partial view in axial section taken on the line VI—VI of FIG. 1, illustrating the method of filling of the reservoir of the central applicator element.
Figure 4:
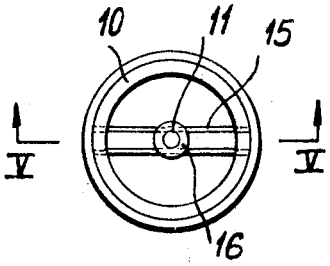
FIG. 4 is a plan view of the base of the central applicator element showing the coupling provided between this element and its driving shaft.
Figure 5:
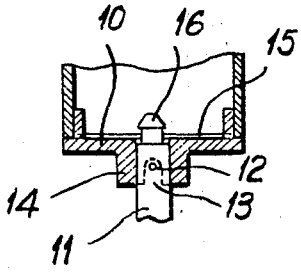
FIG. 5 is a section taken on the line V—V of FIG. 4.

As shown in FIG. 6 the front end of the reservoir 8 of the central applicator member can advantageously comprise a lateral filling aperture 38 opening into the channel 9. This aperture is normally closed by a valve 39 under the action of a compression spring 40 and which bears against a guiding ring 41 carried by the front end of the reservoir 8. This filling aperture 38 is adapted to receive a stem 42 which can be fitted on the spout of a container of the liquid or pasty treating product. It is thus possible to proceed very easily with filling of the reservoir 8 when the latter is empty. However, any other appropriate filling device could be provided for this purpose.

Furthermore, the central applicator element could be constructed in such a manner as to receive a removable reservoir carrying an applicator pad. It would thus be possible to proceed purely and simply with replacement of such a reservoir by another at the desired time. In such a case, the removable reservoir thus provided could if required consist of a gas-aerosol container.

For the purpose of assuring the most rapid drying of the product applied, the present apparatus could likewise be equipped with a fan driven by the motor 3. This latter would then be associated with the annular buffing element.

According to the nature of the product to be applied, the two working elements of the present apparatus could be made in a different manner. In effect, as has already been indicated, this apparatus is intended to be used for the application of products of various natures and not only for dressings for the treatment of leather. It can serve for the application of various products for the treatment for maintenance of other materials, such as wood, stone etc. Furthermore, the annular element may be made in such a manner as to assure the penetration of the treating product and not solely a simple operation of buffing up.

It will be obvious that the apparatus shown has been described by way of simple indication. Furthermore, the apparatus according to the invention is capable of having numerous other forms of construction. Thus, it would be possible to reverse the method of coupling of the two working elements with the central driving shaft, by coupling the annular working element with this shaft, while the central element would be mounted so as to be movable in the axial direction. One would thereby obtain the same result as in the preceding case by reversing the direction of rotation of the motor.

The means of control of the longitudinal displacement of the movable working element of the present apparatus could also be constructed in a different manner.

The stops provided in the form of construction shown could be replaced by any other appropriate system of stops. Moreover, the annular brushing or rubbing element could be provided with an ejection mechanism permitting the dismounting of the corresponding brush for its replacement by another.

I claim:

1. In electrically operable apparatus for the application of a treating product and selectively for subsequent buffing up of the surface treated and the working of the treating product thereinto, having a working head comprising a central applicator element for the product to be applied, an annular rotary brushing and rubbing element disposed about said central applicator element, one of said elements being axially movable with respect to the other of said elements to permit bringing said one of said elements into an axially projecting working position, an electric driving motor, a rotary driving shaft coupled to said motor, one of said elements being coupled to said driving shaft, the improvement which consists in that:

a. said motor is adapted to be rotatable in a first and in a second direction, and b. said two elements are coupled by a coupling system adapted to cause axial displacement of said one of said elements with respect to the other of said elements, in one axial direction and then in the other axial direction, as a result of reversing the direction of rotation of said element coupled to said driving shaft.

2. An electrically operable apparatus, as claimed in claim 1, wherein said central applicator element is coupled to said rotary driving shaft, and wherein said annular brushing and rubbing element comprises a sleeve, and wherein said central applicator element has an external quick-thread and said sleeve has an internal quick-thread coating therewith, and wherein stop means are provided on said sleeve to determine end positions of axial movement of said sleeve with respect to said central applicator element.

3. An electrically operable apparatus, as claimed in claim 1 wherein said central applicator element comprises a reservoir for the product to be applied, a feeder piston in said reservoir for ejecting product therefrom, and compression spring means in said reservoir abutting said piston.

4. An electrically operable apparatus, as claimed in claim 3 wherein said reservoir includes a filling aperture, and comprising a valve on said reservoir for closing and opening said filling aperture, said valve being adapted to receive a stem for connection of the valve to a container of the product to be applied.

5. An electrically operable apparatus, as claimed in claim 3, wherein said central applicator element is mounted removably on an end of said driving shaft, and wherein said central applicator element and said annular brushing and rubbing element form an assembly which can be removed and replaced by another similar assembly.

6. An electrically operable apparatus, as claimed in claim 1, wherein said central applicator element comprises a reservoir removably mounted on said driving shaft and carrying an applicator pad, said reservoir and pad being removable and replaceable by another similar reservoir and pad.

7. An electrically operable apparatus, as claimed in claim 1, wherein said central applicator element includes a reservoir and an applicator pad on said reservoir.

* * * * *